US008214920B1

(12) United States Patent
Edgar et al.

(10) Patent No.: US 8,214,920 B1
(45) Date of Patent: Jul. 10, 2012

(54) HARD HAT ADAPTER FOR A WELDING HELMET

(75) Inventors: Frederick P. Edgar, Dighton, MA (US); Joseph S. Falvo, Johnston, RI (US)

(73) Assignee: Sperian Eye & Face Protection, Inc., Smithfield, RI (US)

( * ) Notice: Subject to any disclaimer, the term of this patent is extended or adjusted under 35 U.S.C. 154(b) by 642 days.

(21) Appl. No.: 12/372,943

(22) Filed: Feb. 18, 2009

Related U.S. Application Data

(60) Provisional application No. 61/029,439, filed on Feb. 18, 2008.

(51) Int. Cl.
*A61F 9/06* (2006.01)

(52) U.S. Cl. ..... 2/8.2; 2/422

(58) Field of Classification Search ..... 2/8.2, 422
See application file for complete search history.

(56) References Cited

U.S. PATENT DOCUMENTS

| | | | | |
|---|---|---|---|---|
| 2,888,681 | A | 6/1959 | Stuart et al. | |
| 3,075,201 | A | 1/1963 | Lindblom | |
| 3,375,529 | A * | 4/1968 | Walter et al. | 2/8.1 |
| 4,109,320 | A * | 8/1978 | Anderson | 2/10 |
| 4,479,738 | A | 10/1984 | Kubnick | |
| 5,165,117 | A * | 11/1992 | Kamata | 2/424 |
| 5,461,731 | A * | 10/1995 | Shida | 2/424 |
| 5,546,610 | A * | 8/1996 | Herzig et al. | 2/422 |
| 5,604,930 | A * | 2/1997 | Petit et al. | 2/6.5 |
| 5,623,730 | A | 4/1997 | Baudou et al. | |
| 5,966,738 | A * | 10/1999 | Wang Lee | 2/10 |
| 6,035,451 | A | 3/2000 | Burns et al. | |
| 6,041,435 | A | 3/2000 | Paulson et al. | |
| 6,264,392 | B1 * | 7/2001 | Wise et al. | 403/112 |
| 6,654,969 | B2 | 12/2003 | Taniuchi | |
| 6,807,679 | B1 * | 10/2004 | Wang-Lee | 2/10 |
| 6,820,285 | B2 | 11/2004 | Bataille et al. | |
| 6,851,129 | B2 | 2/2005 | Gafforio et al. | |
| 6,892,400 | B1 | 5/2005 | Choi et al. | |
| 7,065,798 | B2 * | 6/2006 | Kuo | 2/424 |
| 2006/0117467 | A1 | 6/2006 | Choi et al. | |

FOREIGN PATENT DOCUMENTS

| | | |
|---|---|---|
| JP | 10077520 | 3/1998 |
| SU | 799748 | 1/1981 |
| SU | 1301372 A1 | 4/1987 |

* cited by examiner

*Primary Examiner* — Brian D Nash
(74) *Attorney, Agent, or Firm* — Barlow, Josephs & Holmes

(57) ABSTRACT

A hard hat adapter for a welding helmet is disclosed. The dapater includes a housing which has an outer wall, an interior surface and a bottom surface. The outer wall includes a surface defining a window therethrough. The interior surface includes a recessed surface circumscribing the window. The recessed surface includes at least one planar surface thereon. A rotatable boss is captured within the housing against the interior surface. The boss has an annular lip that includes at least one planar surface thereon configured to selectively engage the planar surface on the recessed surface of the housing and prevent the boss from rotating when engaged thereon and freely rotatable when disengaged therefrom. A mounting post extends from the boss and projects through the window on the housing. The mounting post is configured to selectively couple to a welding helmet. The welding helmet may include a rotatable cam configured to engage a lever arm on the hard hat adapter.

15 Claims, 14 Drawing Sheets

HARD HAT ADAPTER FOR A WELDING HELMET

BACKGROUND OF THE INVENTION

The present patent document claims priority to earlier filed U.S. Provisional Patent Application Ser. No. 61/029,439, filed on Feb. 18, 2008, the entire contents of which are incorporated herein by reference.

BACKGROUND OF THE INVENTION

1. Field of the Invention

The present patent document relates generally to hard hats and more particularly to a hard hat adapter for attaching a face shield or welding helmet to a hard hat.

2. Background of the Related Art

In the construction trades, welding is often required. To ensure the safety of the welders on the jobsite they are required to wear welding helmets and hard hats. A prior art hard hat 10 and welding helmet 12 are shown in FIG. 1. The welding helmet 12 is pivotally connected to the hard hat 10 to enable it to be swung out of the way after welding operations have ceased. FIG. 2 shows a pair of prior art hard hat adapters 14 for connecting a welding helmet 12 to the hard hat 10.

Each prior art adapter 14 includes a base portion 16 with a spring clip 18 depending downwardly that is configured to be removably attachable to mount 20 on a rim 22 of the hard hat 10. The mount 20 includes a slot configured to receive the spring clip 18. When the hard hat 10 is worn, the mounts 20 are located approximately above the left and right ears of the user. An arm 24 is pivotally connected to the base portion 16 of the adapter 14 and includes a mounting post 26 configured to be secured to the welding helmet 12. The arm 24 is also configured and arranged to be adjustable upwards and downwards to allow the user to adjust the height of the welding helmet 12 relative to his or her eyes.

Although this prior art hard hat adapter 14 is useful it suffers from a couple of disadvantages. Specifically, the spacing of the welding helmet 12 relative the user's face is not adjustable, which makes the welding helmet 12 uncomfortable for some users. Additionally, a user cannot quickly or easily adjust the height of the prior art adapter. Accordingly, it would be desirable in the art to have a hard hat adapter for a welding helmet that was more easily and quickly adjustable and a hard hat adapter that permitted adjustment of the spacing between the user's face and the welding helmet.

SUMMARY OF THE INVENTION

The present invention solves the problems of the prior art by providing a hard hat adapter that includes a unique rotating boss contained within a housing of the adapter. A mounting post is eccentrically located on the face of a boss rotatably mounted within the housing. The boss and the interior of the housing are provided with interfitting formations (flats on the boss and in the mating recess) which allow the boss (and the mounting post) to be fixed in four positions (each spaced 90 degrees apart). A spring biases the boss toward the front of the housing to seat the boss in the recess in the desired position. The position is changed by pushing the boss inward to release the flats, rotate the boss to the desired position and release the boss which is then biased forwardly and seated in the new position. Accordingly, the mounting post can be fixed in four different positions (low forward, high forward, high rear, low rear) depending on the preference of the user. The arrangement also includes a lever arm, which can be positioned to move the helmet towards or away from the user's neck.

BRIEF DESCRIPTION OF THE DRAWINGS

These and other features, aspects, and advantages of the present invention will become better understood with reference to the following description, appended claims, and accompanying drawings where:

DESCRIPTION OF THE PREFERRED EMBODIMENT

Figure 1:
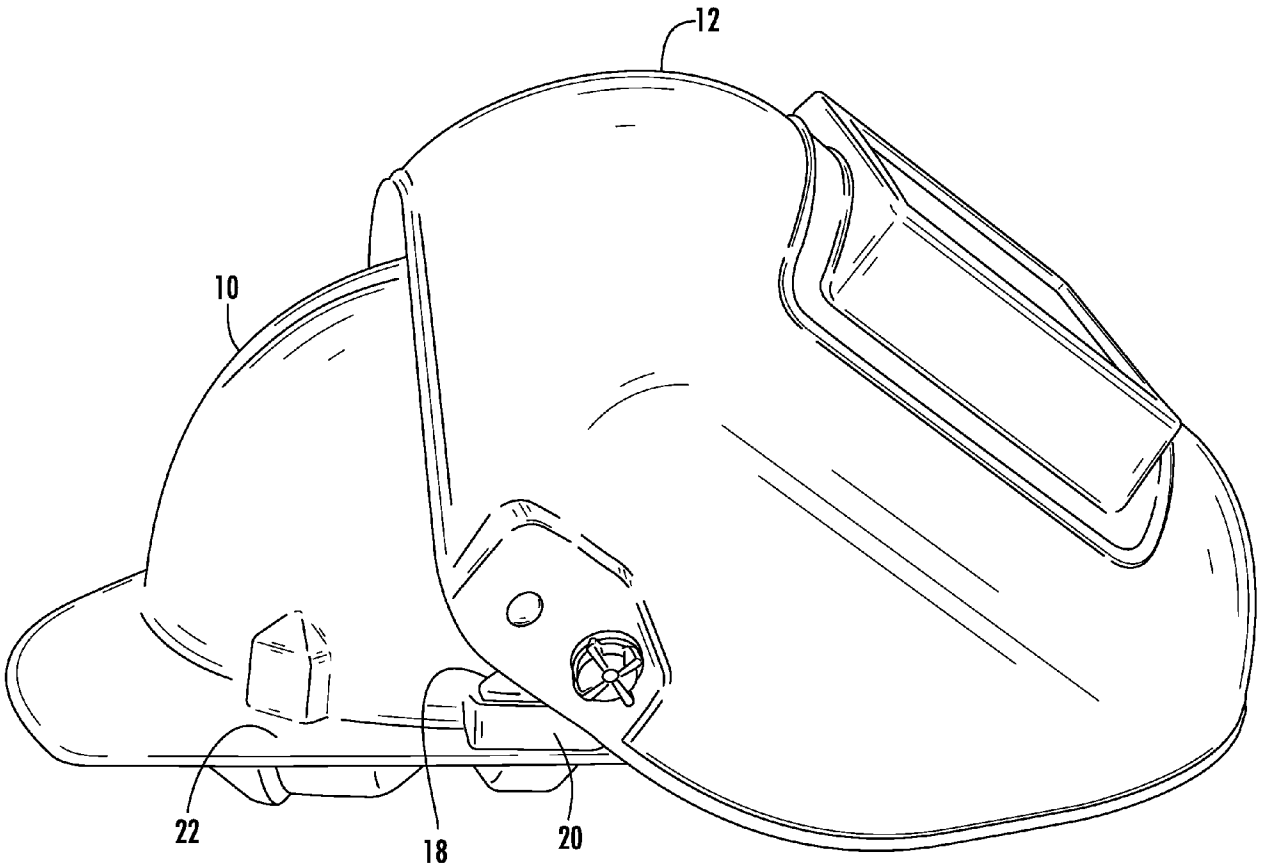
FIG. 1 (PRIOR ART)
FIG. 1 is a perspective view of a prior art hard hat with a welding helmet attached thereto.
Figure 2:
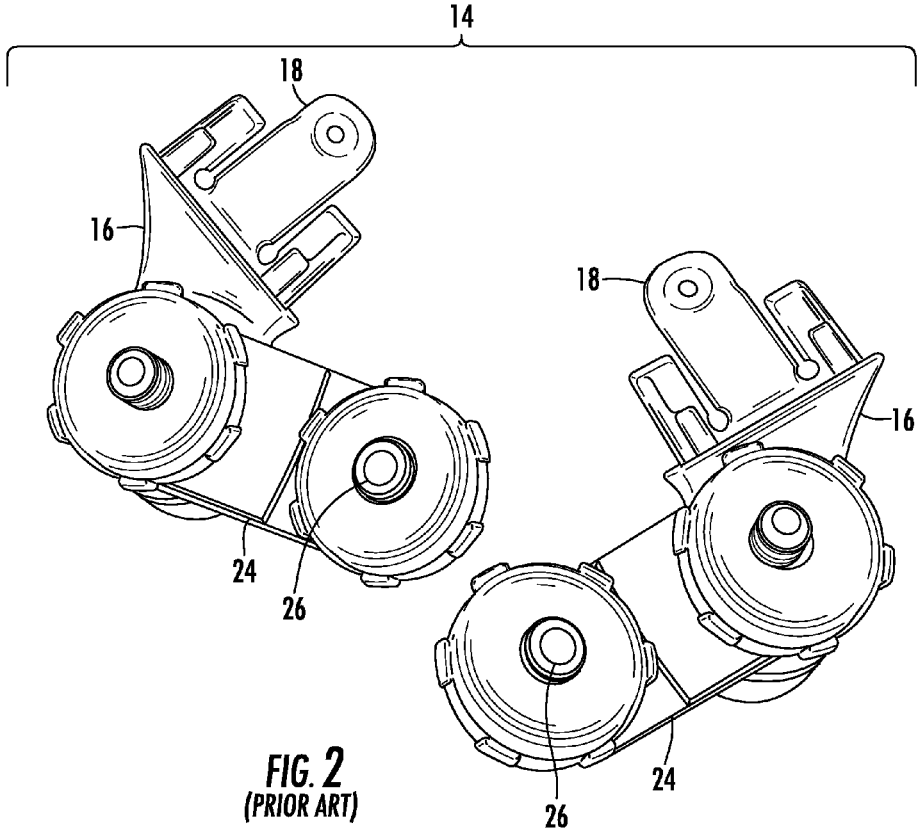
FIG. 2 (PRIOR ART)
FIG. 2 is perspective view of a pair of prior art hard hat adapters.
Figure 3A:
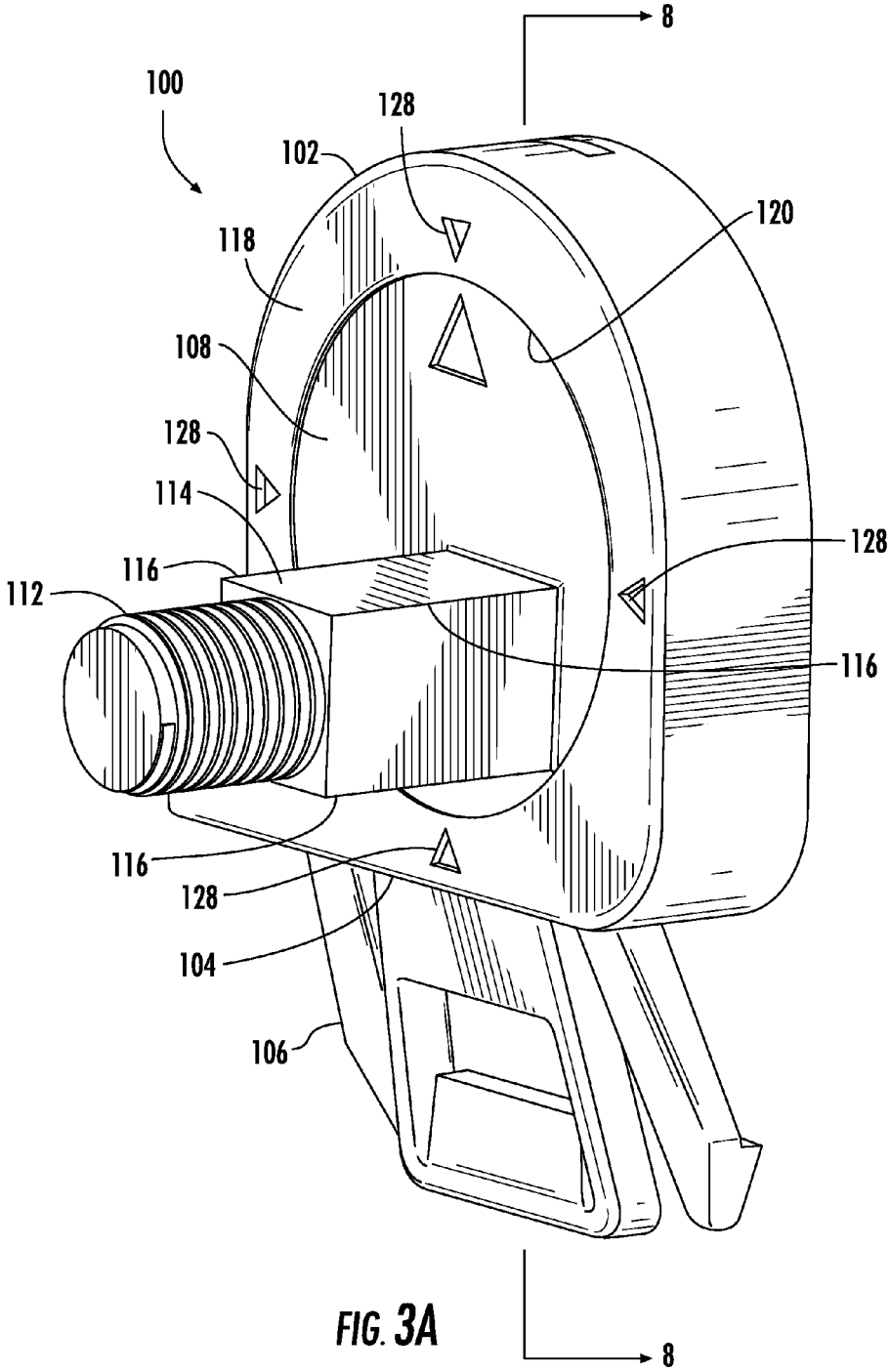
FIG. 3A is a front perspective view of the preferred embodiment of the right hand side of the hard hat adapter of the present invention.
Figure 3B:
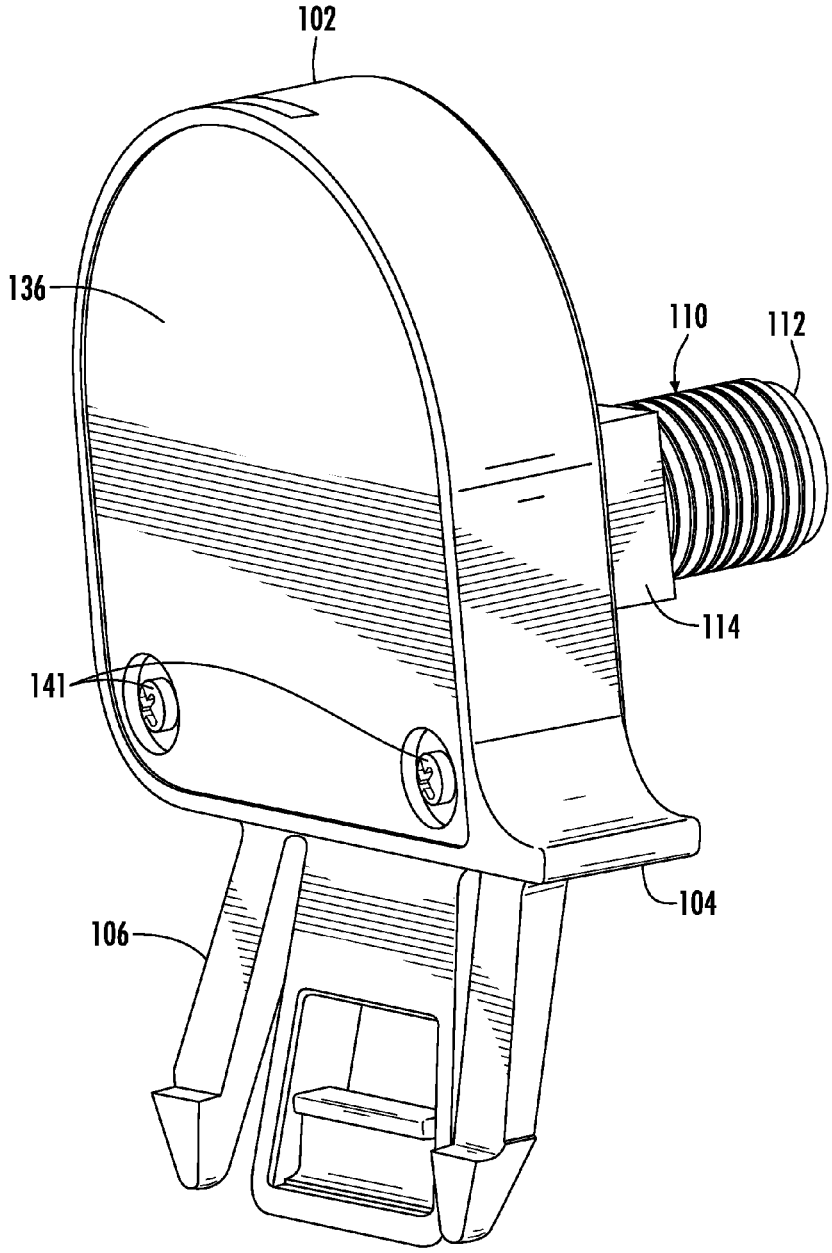
FIG. 3B is a rear perspective view of the preferred embodiment of the right hand side of the hard hat adapter of the present invention.
Figure 4:
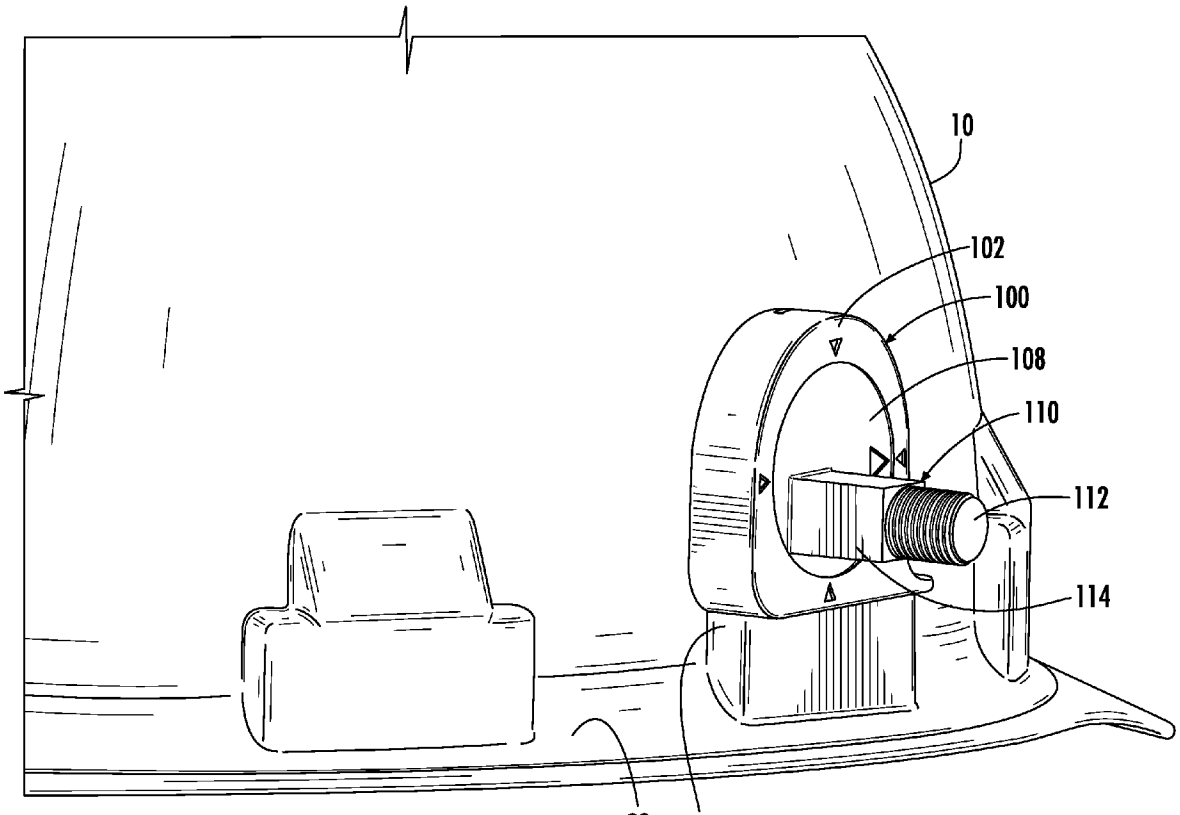
FIG. 4 is a perspective view of the preferred embodiment of the hard hat adapter of the present invention attached to a prior art hard hat.

Referring now to FIGS. 3A and 3B, the preferred embodiment of the hard hat adapter of the present invention is shown generally at 100. The hard hat adapter 100 includes a housing 102 with a bottom surface 104. A spring clip 106 depends from the bottom surface 104 of the housing 102 and is configured to snap into a slot on a mount 20 on a hard hat 10 (best seen in FIGS. 4 and 6). A rotatable boss 108 is captured within the housing 102 and, as will be further described below, is configured and arranged to rotate into, preferably, four different user-selectable stations. However, the number of selectable positions may be increased. A mounting post 110 with a threaded end 112 extends from the boss 108. The mounting post 110 is sized to receive a welding helmet 12 attached thereto. More specifically, the mounting post 110 includes a portion with a square-shaped profile 114 that is frictionally fit into the circular welding helmet mounting holes. The edges 116 on the mounting post 110 engage the circular mounting holes with sufficient resistance to prevent the welding helmet 12 from moving inadvertently, yet permit the welding helmet 12 to be pivoted between the down and up positions with relative ease by the user.

Figure 7A:
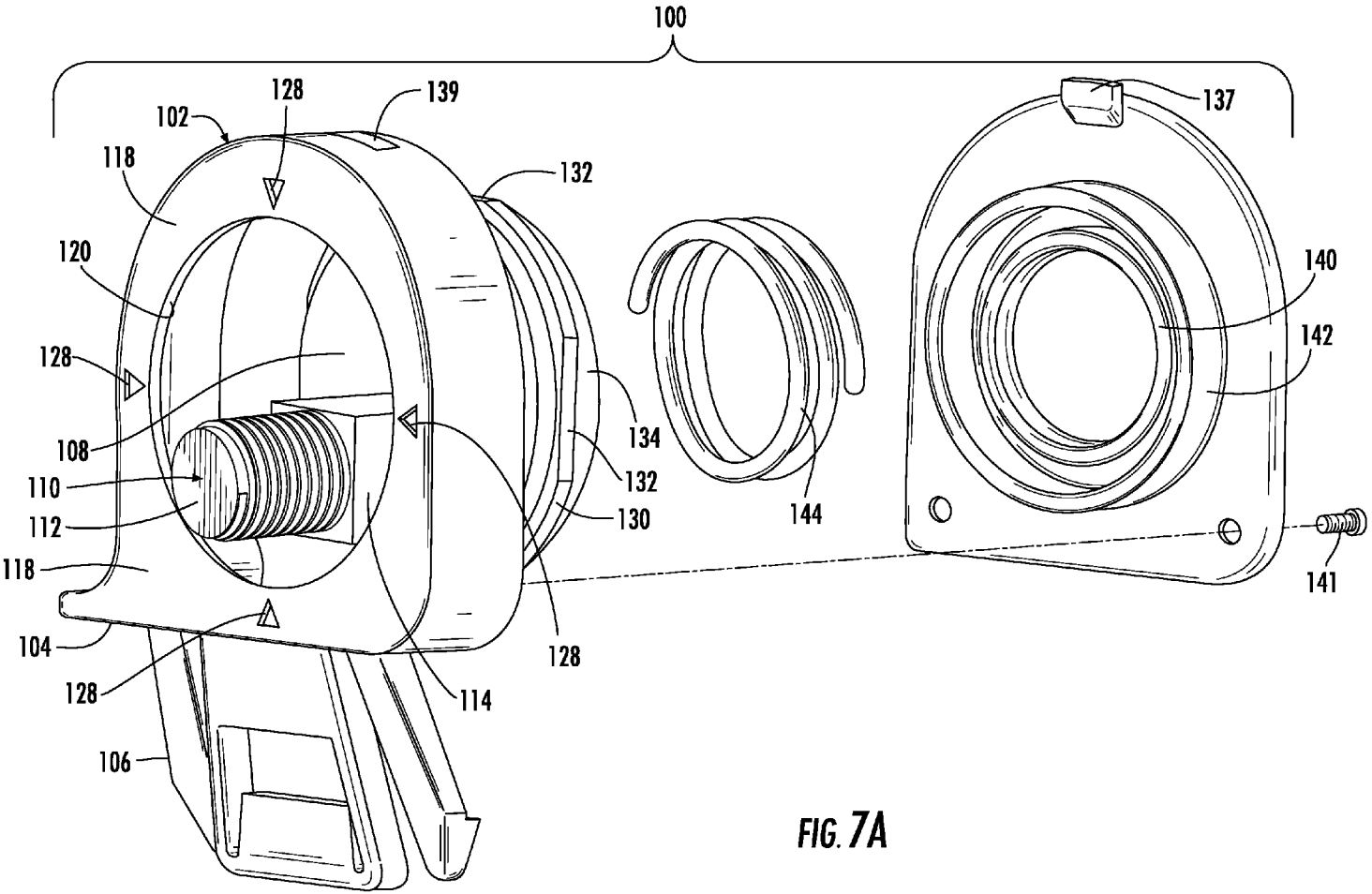
FIG. 7A is an exploded front perspective view of the preferred embodiment of the right hand side of the hard hat adapter of the present invention.
Figure 7B:
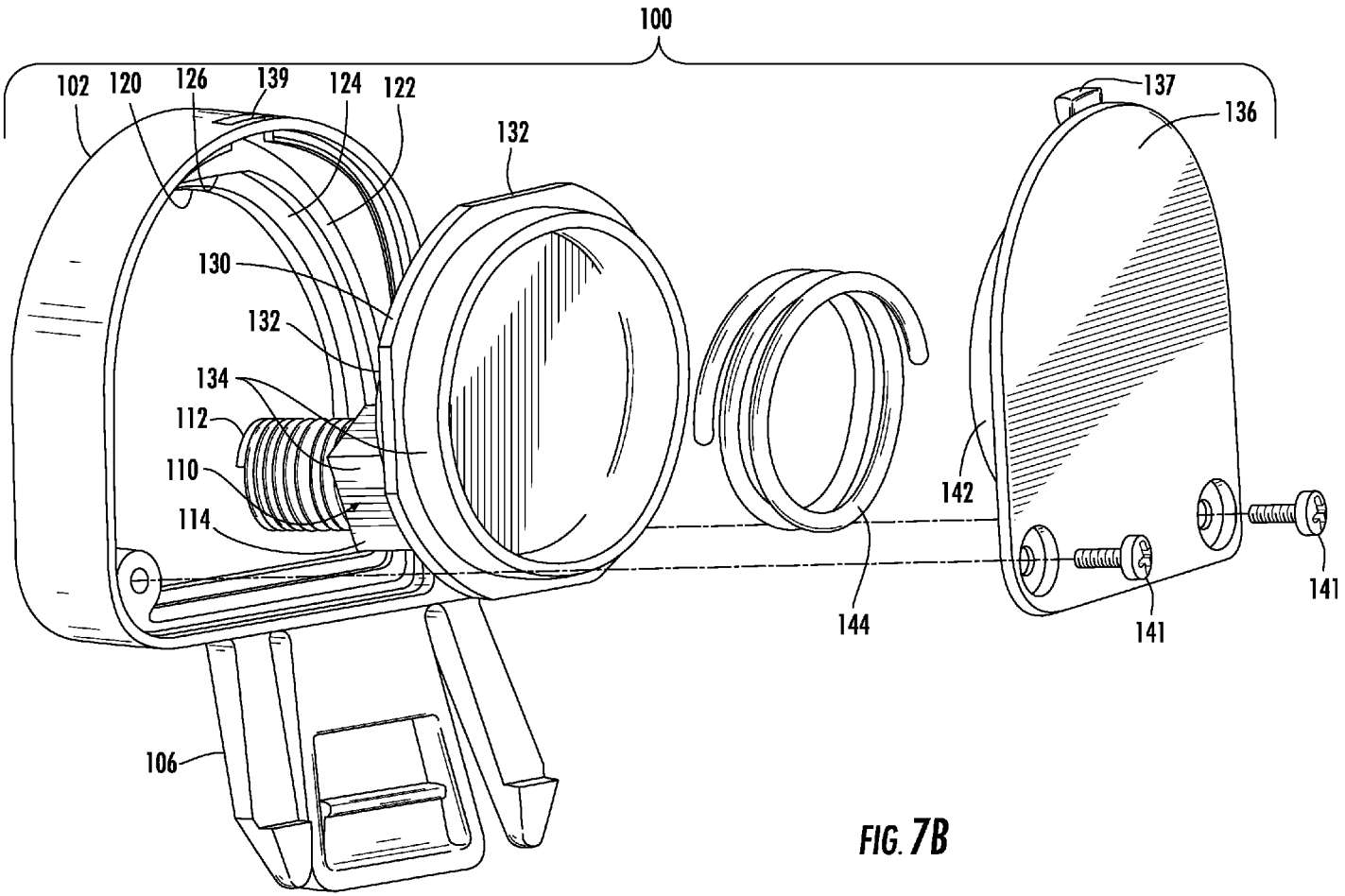
FIG. 7B is an exploded rear perspective view of the preferred embodiment of the right hand side of the hard hat adapter of the present invention.
Figure 8:
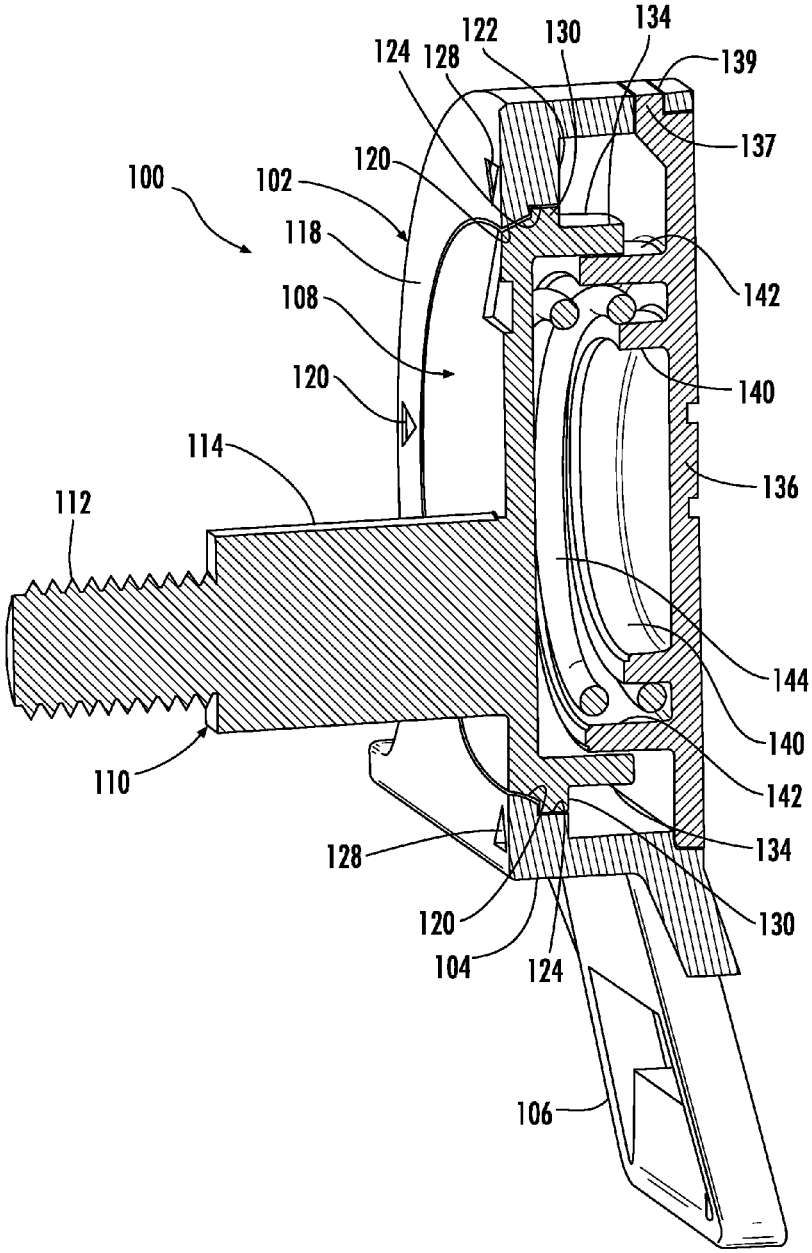
FIG. 8 is a cross-section view through line 8-8 of FIG. 3A.

Referring now to FIGS. 7A, 7B and 8, exploded front and rear views the right hand side of the preferred embodiment of the hard hat adapter 100 of the present invention is generally shown. The left hand side is the mirror image of the right hand side. The housing 102 includes an outer wall 118 with a surface defining a window 120 therethrough. The outer wall 118 also includes an interior surface 122 having a recessed surface 124 circumscribing the window. The recessed surface 124 further includes a number of planar surfaces 126, which form rotational positions indicated by arrows 128. Although four positions are shown, it should be understood that any number of positions desirable could be used.

The boss 108 is received through the window 120 on the housing 102 and is seated in the recessed surface 124. The boss 108 includes an annular lip 130 which is sized and dimensioned to nestle into the recessed surface 124 of the housing 102. In particular, the annular lip 130 includes a number of planar surfaces 132 configured to mate with the planar surfaces 126 on the recessed surface 124 of the housing 102. Like the housing 102, the boss 108 may also include a number of planar surfaces 132 to form multiple positions also. The mounting post 110 extends outwardly from a front surface of the boss 108 and is eccentrically located on the boss 108. The boss 108 also includes a rear surface with an annular wall 134 depending therefrom, which will be described further below.

A rear plate 136 encloses the housing 102 and retains the boss 108 therein. The rear plate 136 includes a tab 137 which cooperates with a slot 139 on the housing. A pair of screws 141 fasten the rear plate 136 to the housing 102. Extending from the rear plate 136 are a pair of concentric walls, an inner wall 140 and an outer wall 142. A spring 144 is captured between the inner and outer walls 140, 142. The outer wall 142 is received into the annular wall 134 of the boss 108. The spring 144 is also captured between the rear plate 136 and the rear surface of the boss 108. The spring 144 biases the boss 108 outwardly from the rear plate 136.

Figure 5:
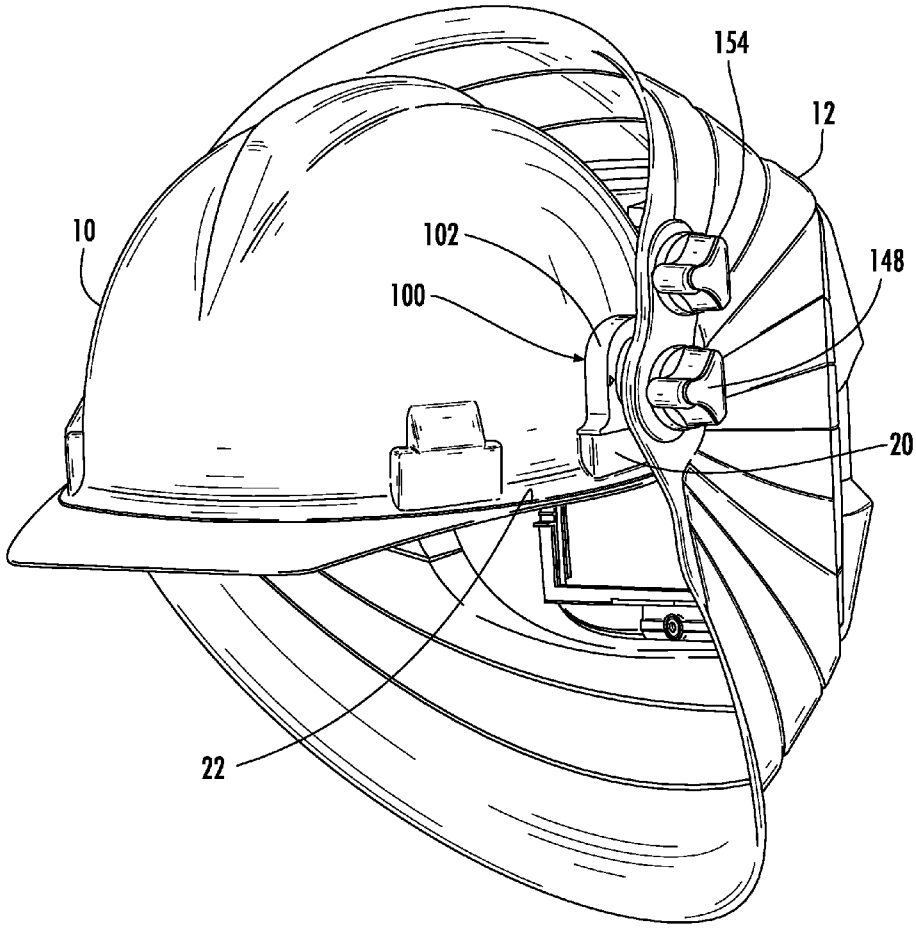
FIG. 5 is a perspective view of the preferred embodiment of the hard hat adapter of the present invention attached to a prior art hard hat and welding helmet.
Figure 6:
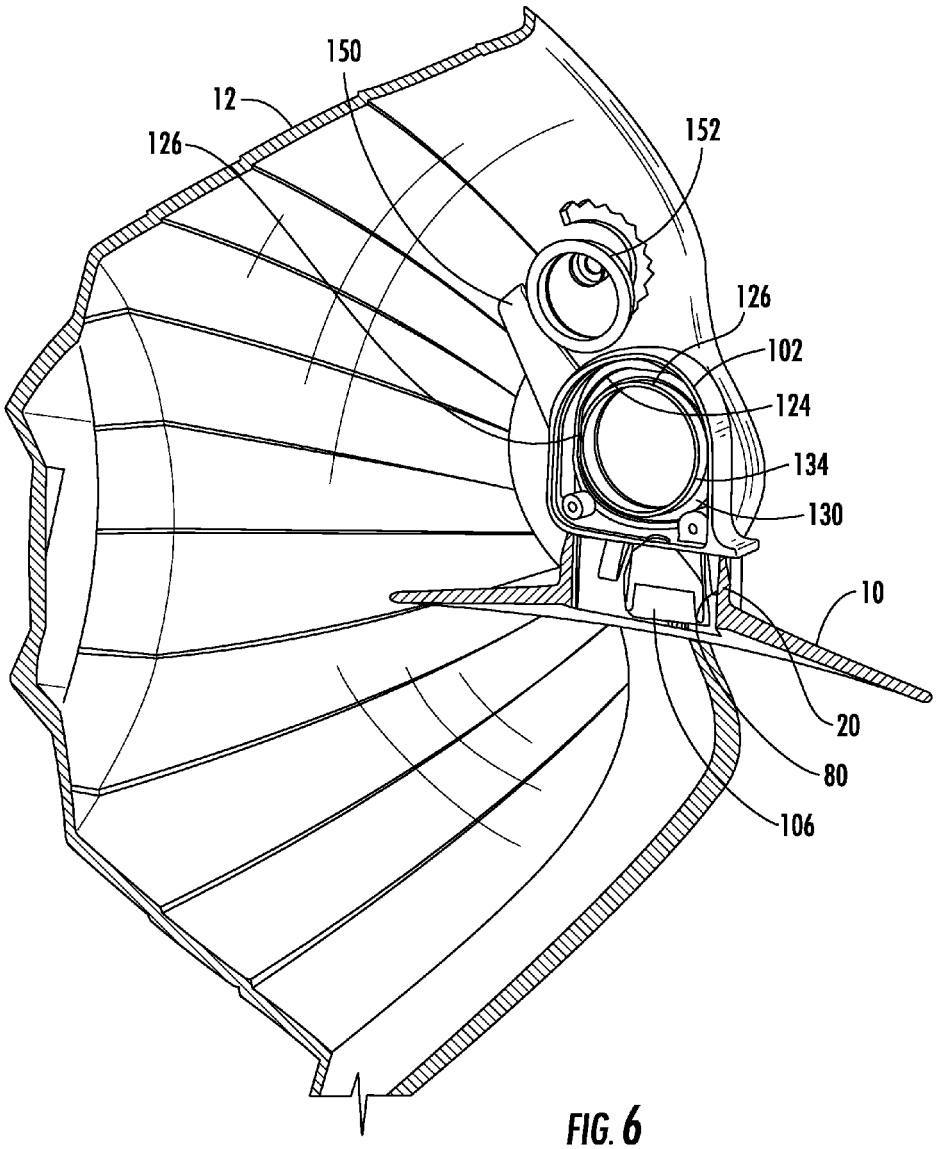
FIG. 6 is a partial cross-section view showing the preferred embodiment of the hard hat adapter of the present invention attached to a prior art hard hat and welding helmet.
Figure 9A:
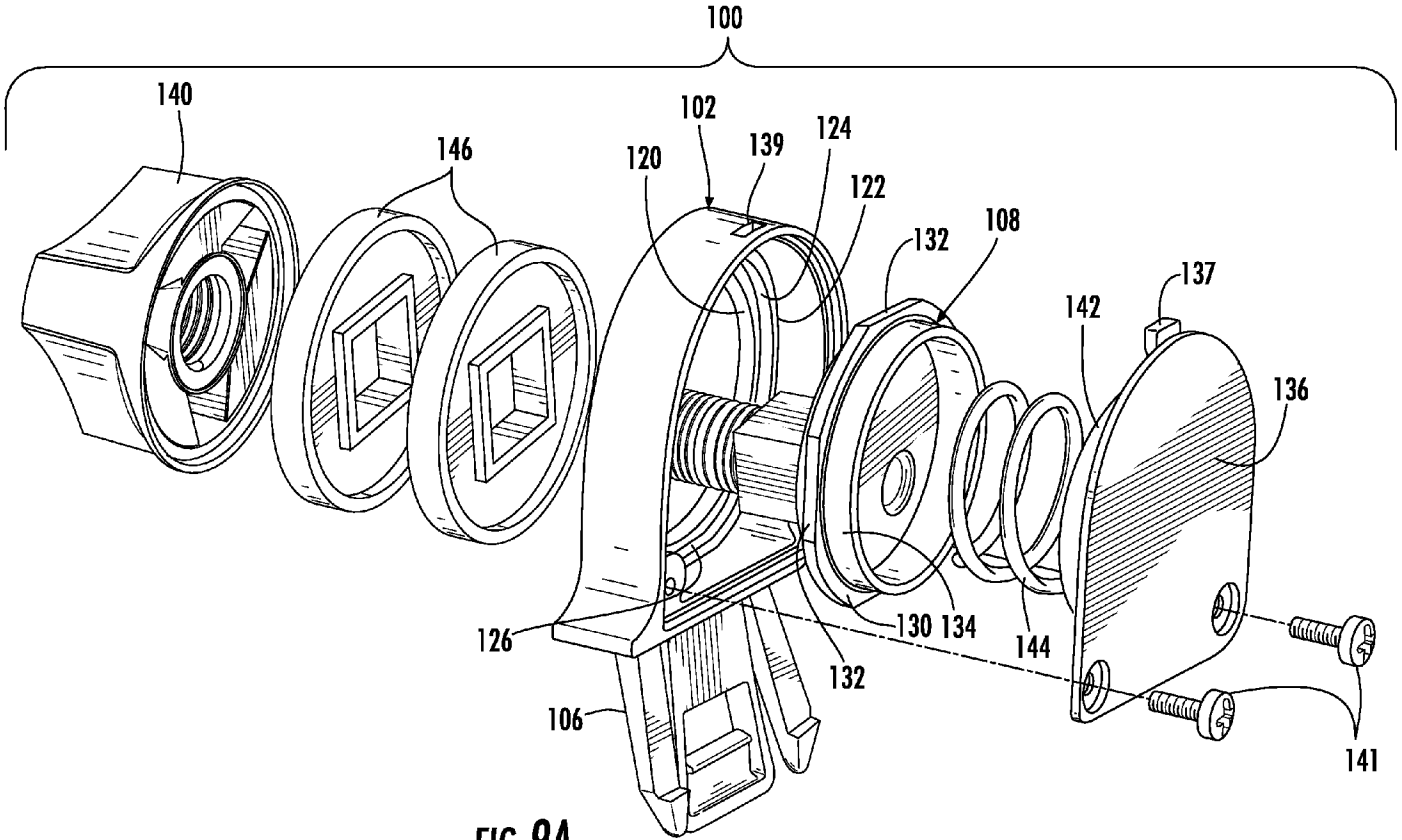
FIG. 9A is an exploded perspective view of the preferred embodiment of the left hand side hard hat adapter of the present invention further showing the spacers and the nut to secure the welding helmet thereto.
Figure 9B:
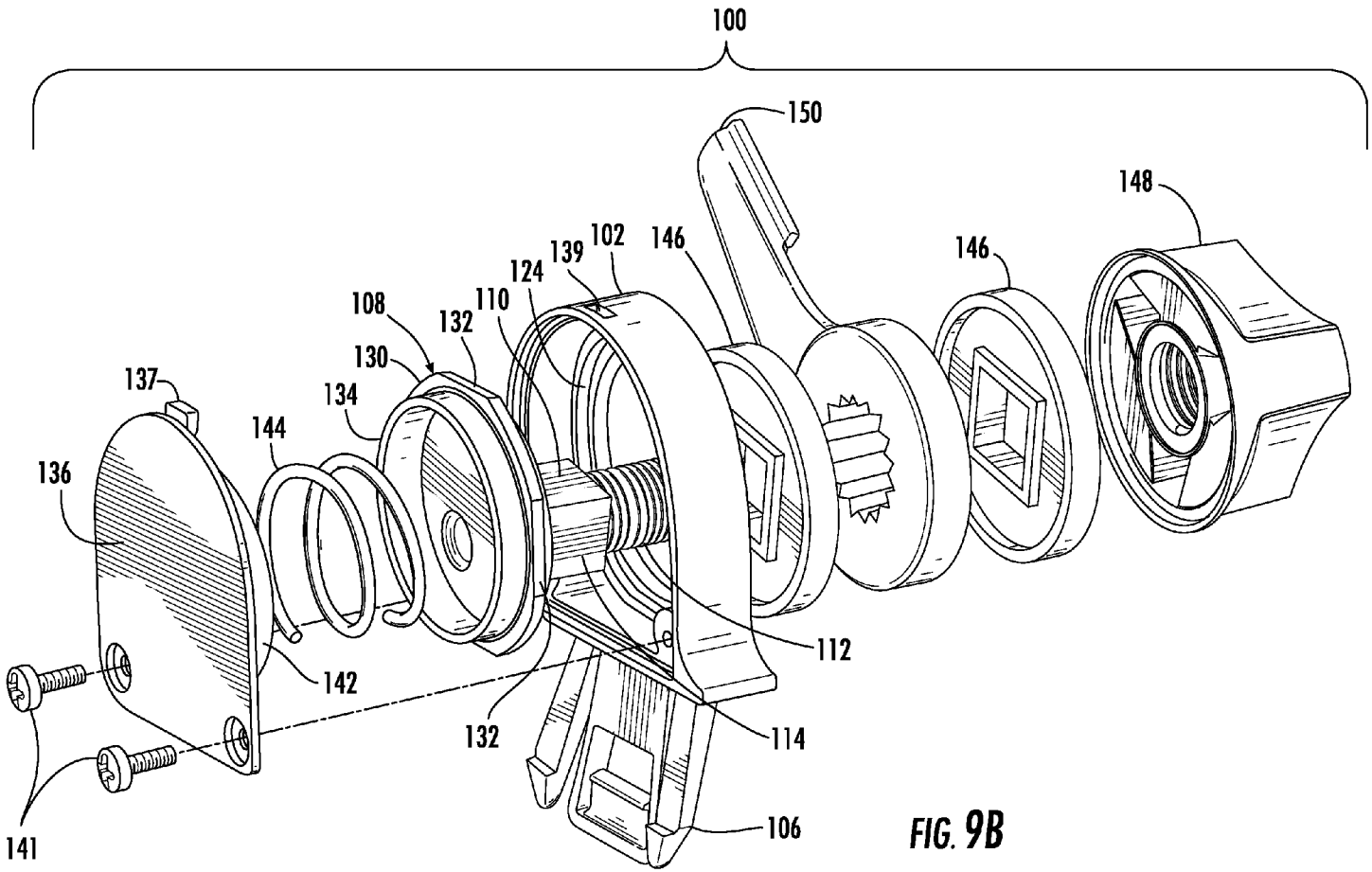
FIG. 9B is an exploded perspective view of the preferred embodiment of the right hand side hard hat adapter of the present invention further showing the spacers and the nut to secure the welding helmet thereto.

Referring now to FIGS. 9A and 9B, exploded views of the left hand and right hand side hard hat adapters 100 are shown. The left hand side further includes spacers 146 and a retaining cap 148 to attach a welding helmet 12 onto the left side mounting post. The right hand side also includes spacers 146 and a retaining cap 148 to attach a welding helmet 12 onto the right side mounting post 110. The retaining caps 148 are threaded onto the threaded ends 112 of the mounting posts 110. The right hand side may further include a lever arm 150 to permit the user to finely adjust the tilt of the welding helmet towards or away from the user's neck. The lever arm 150 is received onto the square-shaped portion 114 of the mounting post 110. The lever arm 150 may be easily located to the left hand side if the user desires. As shown in FIGS. 5 and 6, attached to the welding helmet 12 is a rotatable cam 152 with a knob 154. The cam 152 engages the lever arm 150 and forces the welding helmet 12 to tilt about the mounting post 110 thereby allowing the user to finely adjust the tilt of the welding helmet 12.

By pressing inwardly on the boss 108, the user can adjust the position of the hard hat adapter 100. Specifically, as the user presses inwardly on the boss 108 the spring 144 is biased inwardly and, as a consequence, the annular lip 130 of the boss 108 becomes unseated from the recessed surface 124 on the inner surface 122 of the housing 102. However, the annular wall 134 is pressed further around the outer wall 142 on the rear plate 136, which keeps the boss 108 centered on the window 120. The user may then rotate the boss 108 until the planar surfaces 132 on the annular lip 130 align again with the planar surfaces 126 on the recessed surface 124 of the housing 102. The user then releases the boss 108, which allows the spring 144 to bias the boss 108 outwardly, reseating the annular lip 130 into the recessed surface 124. Because the mounting post 110 is eccentrically located on the boss 108 and there are four positions 128 formed by the planar surfaces 126, 132 on the housing 102 and boss 108, respectively, four positions of the mounting post 110 are formed—forward low, forward high, rearward low and rearward high. As one can appreciate, when a welding helmet 12 is attached to the mounting posts 110 this arrangement of the parts permits the proximity and height of the welding helmet 12 relative to a user's face to be easily and quickly adjustable. Although four positions are shown, any number of positions may be included as desired by increasing the number of planer surfaces 126, 132 on either the housing 102 or boss 108, respectively, as desired.

Figure 10A:
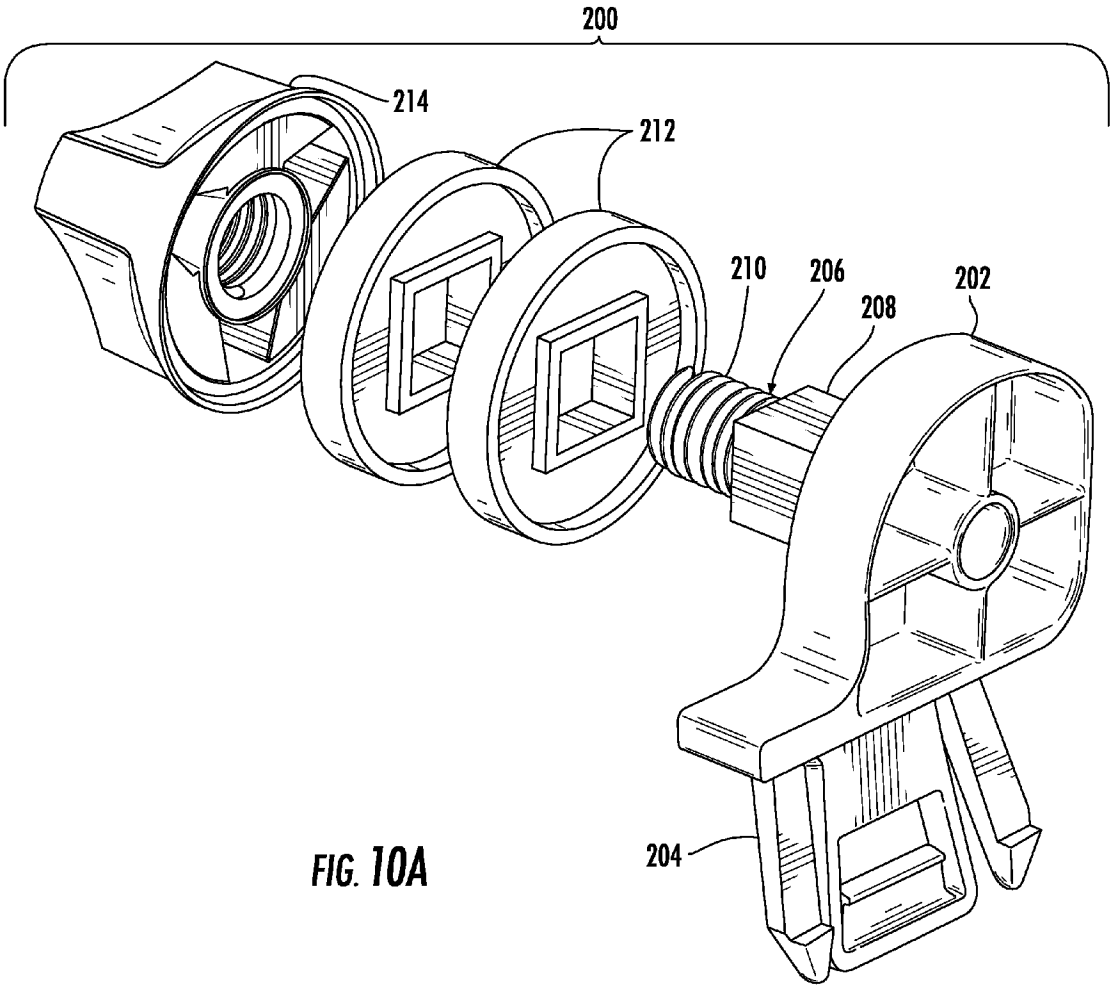
FIG. 10A is an exploded view of an alternative embodiment of the right hand side of the hard hart adapter of the present invention.
Figure 10B:
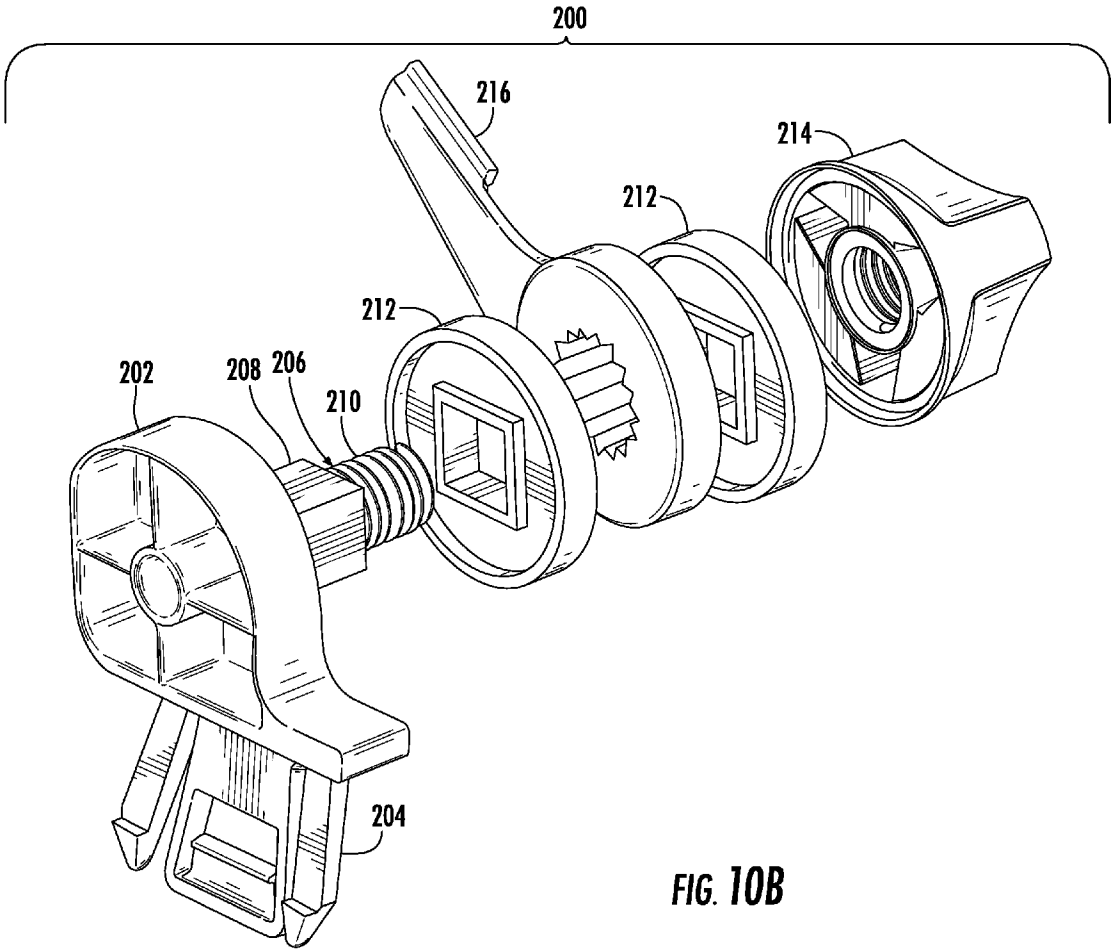
FIG. 10B is an exploded view of an alternative embodiment of the left hand side of the hard hart adapter of the present invention.

FIGS. 10A and 10B show exploded views of an alternative embodiment 200 of the hard hat adapter of the present invention. However, the alternative embodiment 200 is non-adjustable. The alternative embodiment includes a base portion 202. A spring clip 204 depends from the base portion 202 and is configured to snap into a slot on a mount 20 on a hard hat 10. Extending from the base portion 202 is a mounting post 206, which includes a portion 208 with a square-shaped profile and a threaded end 210. Spacers 212 maybe fitted to the mounting post 206 to adjust the fit the welding helmet 12 on the mounting post 206. A retaining cap is 214 threadably received onto the threaded end 210 of the mounting post 206 to retain the welding helmet 12 on the mounting post 206. The alternative embodiment 200 includes a lever arm 216 like the preferred embodiment 100. The lever arm 216 functions in the same manner, that is, it engages a cam 152 on the welding helmet 12 that may be adjustable by a knob 154. The cam 152 engages the lever arm 216 to tilt the welding helmet 12 upwards and downwards.

Therefore, it can be seen that the present invention provides a unique solution to the problem of providing a hard hat adapter for the welding helmet that permits the user to quickly and easily adjust both the height and distance of the welding helmet relative to the user's face. Moreover, the use of a lever arm and adjustable cam permit fine adjustment of the tilt of the welding helmet.

It would be appreciated by those skilled in the art that various changes and modifications can be made to the illustrated embodiments without departing from the spirit of the present invention. All such modifications and changes are intended to be within the scope of the present invention.

What is claimed is:

1. An adapter for fitting a welding helmet to a hard hat, comprising:

a housing including an outer wall and an interior surface, the outer wall including a surface defining a window therethrough, the interior surface including a recessed surface circumscribing the window, the recessed surface including at least one planar surface thereon;

a rotatable boss captured within the housing against the interior surface, the boss having an annular lip including at least one planar surface thereon configured and arranged to selectively engage the at least one planar surface on the recessed surface of the housing and prevent the boss from rotating when engaged thereon and freely rotatable when disengaged therefrom;

a mounting post extending from the boss and projecting through the window on the housing, the mounting post configured and arranged to selectively couple to a welding helmet; and a spring biasing said boss against said interior surface of said housing.

2. The article of claim 1, further comprising a spring clip depending from a bottom surface of said housing configured and arranged to selectively couple to a hard hat.

3. The article of claim 1, wherein said mounting post has a portion with a square-shaped profile and a portion with a threaded end.

4. The article of claim 1, further comprising a nut threadably received onto said threaded end of said mounting post.

5. The article of claim 1, further comprising a lever arm extending from said mounting post.

6. The article of claim 1, further comprising at least one spacer received on said mounting post.

7. The article of claim 1, wherein said annular lip on said boss includes four spaced apart planar surfaces thereon.

8. The article of claim 1, wherein said recessed surface on said housing include four spaced apart planar surfaces thereon.

9. An adapter for fitting a welding helmet to a hard hat, comprising:

a housing including an outer wall, an interior surface and a bottom surface, the outer wall including a surface defining a window therethrough, the interior surface including a recessed surface circumscribing the window, the recessed surface including at least one planar surface thereon;

a rotatable boss captured within the housing against the interior surface, the boss having an annular lip including at least one planar surface thereon configured and arranged to selectively engage the at least one planar surface on the recessed surface of the housing and prevent the boss from rotating when engaged thereon thereon and freely rotatable when disengaged therefrom;

a spring biasing the boss against the interior surface of the housing;

a mounting post extending from the boss and projecting through the window on the housing, the mounting post configured and arranged to selectively couple to a welding helmet; and a spring clip depending from the bottom surface of the housing configured and arranged to selectively couple to a hard hat.

10. The article of claim 9, wherein said mounting post has a portion with a square-shaped profile and a portion with a threaded end.

11. The article of claim 10, further comprising a nut threadably received onto said threaded end of said mounting post.

12. The article of claim 9, further comprising a lever arm extending from said mounting post.

13. The article of claim 9, further comprising at least one spacer received on said mounting post.

14. The article of claim 9, wherein said annular lip on said boss includes four spaced apart planar surfaces thereon.

15. The article of claim 9, wherein said recessed surface on said housing include four spaced apart planar surfaces thereon.

* * * * *